US007550241B2

(12) United States Patent
Lee et al.

(10) Patent No.: US 7,550,241 B2
(45) Date of Patent: Jun. 23, 2009

(54) POSITIVE CHARGEABLE MAGNETIC TONER COMPOSITION

(75) Inventors: Won-Sup Lee, Daejeon (KR); Chang-Soon Lee, Daejeon (KR); Joo-Yong Park, Daejeon (KR); Hyeung-Jin Lee, Daejeon (KR)

(73) Assignee: LG Chem Ltd., Seoul (KR)

( * ) Notice: Subject to any disclaimer, the term of this patent is extended or adjusted under 35 U.S.C. 154(b) by 362 days.

(21) Appl. No.: 11/049,938

(22) Filed: Feb. 4, 2005

(65) Prior Publication Data

US 2005/0175917 A1 Aug. 11, 2005

(30) Foreign Application Priority Data

Feb. 6, 2004 (KR) ..... 10-2004-0007908
Feb. 2, 2005 (KR) ..... 10-2005-0009363

(51) Int. Cl.
*G03G 9/083* (2006.01)

(52) U.S. Cl. ..... 430/106.1; 430/108.11; 430/108.2; 430/108.6; 430/108.7; 430/106.2; 430/106.3

(58) Field of Classification Search ..... 430/108.11, 430/108.7, 108.6, 108.2, 106.1, 106.2, 106.3
See application file for complete search history.

(56) References Cited

U.S. PATENT DOCUMENTS 4,933,251 A 6/1990 Ichimura et al.
5,041,351 A 8/1991 Kitamori et al.
5,053,305 A 10/1991 Aoki et al.
5,290,650 A * 3/1994 Shintaku et al. ..... 430/108.6
5,312,711 A 5/1994 Tavernier et al.
5,482,808 A * 1/1996 Kondo et al. ..... 430/108.11
5,512,406 A 4/1996 Takeda et al.
6,103,441 A 8/2000 Tomita et al.
6,127,081 A 10/2000 Yamauchi
6,287,739 B1 * 9/2001 Kawakami et al. ..... 430/108.6
6,566,025 B1 * 5/2003 McStravick et al. .... 430/108.11

FOREIGN PATENT DOCUMENTS

EP 0 050 987 5/1982
GB 2 034 907 6/1980
JP 10-326028 12/1998
JP 11-153886 6/1999
KR 10-2003-0056152 7/2003
WO WO03087951 A * 10/2003

* cited by examiner

*Primary Examiner*—Christopher RoDee
(74) *Attorney, Agent, or Firm*—McKenna Long & Aldridge LLP

(57) ABSTRACT

The present invention relates to a magnetic mono-component toner composition with positive charge comprising i) a magnetic toner particle containing a charge control agent with positive charge; ii) a hydrophobic silica with negative charge; iii) a fluorinated organic fine powder; and iv) a metal oxide fine powder containing 20 to 80 wt % of tin oxide. The toner has an advantageous in the extended life of the drum, reduction of the background contamination, and improvement of long-term reliability, and thus can be used effectively for image forming apparatus.

9 Claims, No Drawings

POSITIVE CHARGEABLE MAGNETIC TONER COMPOSITION

CROSS-REFERENCE TO RELATED APPLICATIONS

This application claims priority of Korean Patent Application No.10-2004-0007908 filed on Feb. 6, 2004, and Korean Patent Application No. 10-2005-0009363 filed on Feb. 2, 2005 in the Korean Intellectual Property Office, the disclosure of which is incorporated herein by references.

BACKGROUND OF THE INVENTION (a) Technical Field

The present invention relates to a positive chargeable magnetic toner composition providing the extended life of the drum, reduction of the background contamination (fogging image), and improvement of long-term reliability.

(b) Description of the Related Art

In general, the dry-process developing systems in electrophotography can be largely classified into dual-component developing system using a dual-component developer comprising a toner and a carrier, and mono-component developing system using a mono-component developer comprising a toner only. The mono-component developing system is advantageous in compactness, low cost, and easy maintenance. Recently, the copier and printer adopting mono-component developing system are widely spread, and the printing speed is notablely improved.

Differing from the dual-component toner comprising carrier particles transferring toner particles, the fluidity of toner particles greatly affects the transfer characteristics of toner in the non-magnetic mono-component toner.

In the non-magnetic mono-component developing system, the thickness of toner layer on the developing roller is controlled by pressing the developing roller with metal or resin blade. In the dual-component developing system, the toner is transferred to the developing roller by charging the toner with friction between the toner and carrier.

However, in case of the magnetic mono-component developing system, the toner is transferred to developing roller by using magnetic force as driving force. That is, doctor blade is arranged so as to make contact with a developing roller, and the mono-component toner is triboelectrically charged by passing between doctor blade and developing roller. The charge toner is maintained on the surface of the developing roller by electrostatic force.

A charged toner is used for visualizing the latent image on drum. If organic photo conductor (OPC) drum which is manufactured by coating at least an organic layer is repeatedly contacted with toner on its surface in a long time, it is difficult to form an image because of the abrasion of OPC surface. Such problem increases fogging image in non-imagining region and makes image density (i.e., blackness) insufficient.

In the prior art, to prevent the lower image quality caused by drum surface abrasion, Japanese Patent Laid-Open No. H10-326028 discloses a method of using alumina particle in combination of silica with high hardness which is used for obtaining the fluidity of toner. In addition, Japanese Patent Laid-Open No. H11-153886 discloses a positive chargeable color toner containing a urethane-modified polyester resin as binder resin in toner particle.

However, the prior arts do not effectively reduce the abrasion of drum surface, because the large amount of silica can not be reduced or used. In addition, if the amount of added silica is excessively reduced, the image density is insufficient because the decreased fluidity and increased coadhesion force of toner decreases the transfer efficiency. There is practical difficulty in preventing the abrasion of drum surface, and obtaining the high image density at the same time.

Therefore, it is still required to provide a positive chargeable toner which extends the drum life by reducing the abrasion of developing drum surface despite of copying in a long period of time, reduces the background contamination (fogging image by obtaining the excellent triboelectrification, and improves the long-term reliability by maintaining the high image density.

SUMMARY OF THE INVENTION

To strive for a magnetic toner composition providing the extended life of the drum, reduction of the background contamination (fogging image, and improvement of long-term reliability, the inventors of the present invention, it is found that the toner composition comprising (i) toner mother particle, (ii) silica which has opposite charge to the magnetic toner particle, (iii) metal oxide fine powder containing the tin, (iv) fluorinated organic fine powder An object of the present invention is to provide a positive chargeable magnetic mono-component toner composition having the extended life of the drum, reduction of the background contamination (fogging image, and improvement of long-term reliability Another object of the present invention is to provide a method of applying the positive chargeable magnetic toner composition for an image forming apparatus comprising OPC to form an image in the non-contacting developing system.

DETAILED DESCRIPTION OF THE EMBODIMENTS

In order to obtain the object, the present invention provides a positive chargeable magnetic mono-component toner composition comprising:

(i) a toner mother particle comprising a binder resin, a magnetic component, and a charge control agent with positive charge;

(ii) a hydrophobic silica with negative charge having a specific surface area of 80 to 200 $m^2/g$;

(iii) a fluorinated organic fine powder; and (iv)) metal oxide fine powder containing 20 to 80 wt % of tin oxide.

In the present invention, the magnetic toner particle comprises 20 to 80 parts by weight of binder resin, 20 to 70 parts by weight of magnetic component, and 0.15 to 4 parts by weight of charge control agent with positive charge.

In the present invention, the particle size of the magnetic toner particle is not limited particularly, but is preferably 5 to 30 μm. The magnetic toner particle can be prepared by melting, kneading, and pulverizing method, or polymerization, etc.

In the present invention, all the binder resin used in the art can be used. In particular, the binder resin may be obtained from polymerization of an alcohol and a carboxylic acid. The binder resin is preferably contained in the amount of 20 to 80 parts by weight in the magnetic toner particle.

The alcohol may be a secondary or higher alcohol, such as ethylene glycol, diethylene glycol, triethylene glycol, polyethylene glycol, propylene glycol, butanediol, pentanediol, hexanediol, cyclohexanedimethanol, xylene glycol, bisphenol A, bisphenol A ethylene oxide, bisphenol A propylene oxide, sorbitol, and glycerine, an alcohol derivative, or a mixture thereof. The carboxylic acid may be a secondary or higher carboxylic acid, such as maleic acid, fumaric acid, phthalic acid, isophthalic acid, terephthalic acid, succinic acid, adipic acid, trimeritic acid, cyclopentanedicarboxylic acid, succinic acid anhydride, trimeritic acid anhydride, and maleic acid anhydride, a carboxylic acid derivative, a carboxylic acid anhydride, and a mixture thereof.

The examples of the binder resin are an methacrylic acid ester polymer such as polyester, poly(methyl acrylate), poly (ethyl acrylate), poly(butyl acrylate), poly(2-ethylhexyl acrylate), and poly(lauryl acrylate); a methacrylic acid ester polymer such as poly(methyl methacrylate), poly(butyl methacrylate), poly(hexyl methacrylate), poly(2-ethylhexyl methacrylate), and poly(lauryl methacrylate); a copolymer of acrylic acid ester and methacrylic acid ester; a copolymer of a styrene monomer and acrylic acid ester or methacrylic acid ester; an ethylene polymer such as poly(vinyl acetate), poly (vinyl propionate), poly(vinyl lactate), polyethylene, and polypropylene, and copolymers thereof; a styrene copolymer such as a styrene-butadiene copolymer, a styrene-isoprene copolymer, and a styrene-maleic acid copolymer; poly(vinyl ether); poly(vinyl ketone); polyester; polyamide; polyurethane; a rubber; an epoxy resin; a poly(vinyl butyral) resin; a modified resin; a phenol resin; and a mixture thereof. Among them, stryren-butadiene copolymer is more preferable.

In the present invention, the magnetic component can be a ferromagnetic element, alloys thereof, and mixtures thereof, a polyheral type magnetic component, or an acicular type magnetic component. Specific examples of the magnetic component are iron oxide such as magnetite, hematitie, and ferrite; metal such as iron, cobalt, nickel, and manganese; metal alloy containing aluminium, copper, lead, magnesium, selenium, titanium, tungsten, vanadium, and the metal, or the mixture thereof; ferromagnetic alloy; magnetic oxide, etc. Preferably, the magnetic component is a fine powder with a average diameter equal to or smaller than 1 μm. The amount of the magnetic component is preferably 20 to 70 parts by weight with a respect to the magnetic toner particle.

For the examples of the charge control agent with positive charge, nigrosine; quaternary ammonium salts such as tributybenzylammonium-1-hydroxy-4-naphtosulfonate, tetrabutylammonium tetrafluoroborate; onium salt such as phosphonium salt and lake compounds of these pigments tirphenylmetal dye and lake compounds of these pigments; fatty acid metal salt; diorganotin such as dibutyl tin; diocty tin; dicyclohexyl tin; organoborate tin salt such as dibutylborate tin salt, dioctylborate tin salt, dicyclohexylborate tin salt; guanidine compounds; imidazole compounds, and the mixtures thereof can be used alone or in combination of at least two components. In the examples, tungsten phosphate, molybdenum phosphate, tannic acid, lauric acid, gallic acid, ferric cyanic acid, and ferro cyanic acid etc. can be used for the laking agent. More preferably, nigrosine and quaternary ammonium salts are used for the charge control agent.

The amount of the charge control agent is particularly limited, but is preferably 0.15 to 4 parts by weight with respect to 100 parts by weight the magnetic toner particle In addition, the releasing agent may be added for preventing off-set of the magnetic toner particle. The examples of the releasing agent are various waxes and olefin resin with low molecular weight including polypropylene, polyethylene, and propylene-ethylene copolymer, etc, preferably polyethylen. The amount of releasing agent is preferably 0.05 to 5 parts by weight with respect to 100 parts by weight of the magnetic toner particle. In the present invention, the hydrophobic silica with negative charge prevents uneven triboelectrification caused by agglomerization of toner particle, and improves uniform triboelectrification by uniformly spreading the toner after passing the doctor blade. The specific surface area of the hydrophobic silica is preferably 80 to 200 $m^2l/g$, more preferably 100 to 150 $m^2/g$.

In particular, for the hydrophobic silica with positive charge, a coupling agent contain amine is used for treating hydrophobic silica with positive charge to provide with environmental independence and positive charge. The coupling agent containing amine is sensitive to the humidity, and thus, deteriorating long-term reliability of toner. In addition, because triboelectrification of toner itself and the electrostatic force which makes the toner to adhere to the drum surface increases, such decreases the transfer efficiency of the toner to transfer member such as paper. Such problem is more serious, when the hydrophobic silica with positive charge which is treated by the coupling agent contain amine is used in a long term.

In the present invention, if specific surface area of the hydrophobic silica with negative charge is less than 80 $m^2/g$, it causes the problems of insufficient fluidity of the toner, and uneven solid image for printing many solid images. If it exceeds 200 $m^2/g$, silica is embedded in the surface of toner mother particle, the fluidity decreases.

In the present invention, the hydrophobic silica with negative charge is contained in the amount of 0.1 to 0.5 parts by weight with respect to 100 parts by weight of toner mother particle. If the amount of the silica is less than 0.1 parts by weight, the insufficient fluidity of the toner causes uneven image density. If the amount of the silica is more than 0.5 parts by weight, the increased negative charge causes the insufficient triboelectrifcation. Thus, insufficient triboelectrifcation produces the background contamination caused by a positive chargeable toner, and lowers the image density.

The hydrophobic treatment of silica particle is performed by coating or adhering with a silane coupling agent or silicone oil.

For the silane coupling agent, dimethyldichlorosilane, trimethylchlorosilane, methyltrichlorosilane, arylphenyidichlorosilane, benzyldimethylchlorosilane, bromomethyldimethylchlorosilane, p-chlorophenyltrichlorosilane, 3-chloropropyltrimethoxysilane, vinyltriethoxysilane, vinyltriacetoxysilane, divinylchlorosilane, hexamethylene disilazene, etc., may be used.

The silicone oil can be applied to hydrophobic treatment of the silica to lower the background contamination. In the example of the hydrophobic treatment, one having a viscosity at 25° C. of 50-10,000 cps (centipoises), such as dimethylsilicone oil, methylphenylsilicone oil, methylhydrogen silicone oil, alkyl-modified silicone oil, fluorine-modified silicone oil, alcohol-modified silicone oil, amino-modified silicone oil, epoxy-modified silicone oil, epoxy polyethylene-modified silicone oil, phenol-modified silicone oil, carboxyl-modified silicone oil, and mercapto-modified silicone oil, may be used.

The hydrophobic treatment using the silicone oil is not particularly limited, as long as the silicone oil is attached on the surface of the inorganic particle. For example, silica is mixed in a mixing tank, added by spray of silicone oil diluted with a solvent, heated, and dried in the mixing tank while stirring.

The hydrophobic silica is attached to the toner particle using a stirrer such as a turbine type stirrer, a Henschel mixer, or a super mixer, or by using a surface modifying apparatus ("Nara Hybridization System," Nara Machinery Co., Ltd.). The hydrophobic silica may be weakly attached to the toner particle or part of it may be embedded in the surface of the toner particle.

In the present invention, the specific surface area of the hydrophobic silica means the value measured according to the Brunauer, Emmett, Teller (BET) method. The specific surface area may be measured using, for example, the commercially available high-precision automatic gas adsorption apparatus. Inert gas, particularly nitrogen gas, is used as an adsorption gas to determine the amount of gas adsorption required to form a single molecular layer on the surface of the hydrophobic silica particle. The BET specific surface area (S, $m^2/g$) is determined from the measurement.

In the present invention, the fluorinated organic fine powder prevents abrasion of the drum surface, and increases the transfer efficiency of toner. Thus, it maintains the high image density, although the tone is used in a long term.

The fluorinated organic fine powder is fine powder including fluororesin such as polyfluorovinylidene, polytetrafluoroethlyene; fluorinated stryren-acrylic acid copolymer; fluorinated polyethylene; fluorinated polyacrylate; and copolymer thereof. Fluorination method known in the art can be used, and is particular limited in the present invention.

The average particle size of the fluorinated organic fine powder is preferably 0.1 to 4.0 μm, more preferably 0.15 to 3.5 μm. If the average particle size is less than 0.1 μm, the toner blocking occurs at high temperature due to because the organic fine powder is insufficiently adhered to toner mother particle. If the average particle size is more than 4.0 μm, the fusion property of toner become poor due to separation of the organic fine powder from the magnetic toner particle.

The amount of the fluorinated organic fine powder is preferably 0.05 to 0.4 parts by weight, more preferably 0.1 to 0.3 parts by weight with respect to 100 parts by weight of the magnetic toner particle. If the amount is less than 0.05 parts by weight, it is difficult to prevent the abrasion of the drum surface due to insufficient formation of organic fine powder layer on tone mother particle. If the amount is more than 0.4 parts by weight, opposite charging toner occurs due to the separation of the organic fine from the magnetic toner particle, and thereby causing the background contamination.

In the embodiment, the metal oxide fine powder can notably prevent the abrasion of the drum surface, and drum contamination that is the toner fused on drum surface, when many images are printed in a long period of time.

The metal oxide fine powder has an average particle size of 50-500 nm, preferably 60-300 nm. If the average particle size is smaller than 50 nm or larger than 500 nm, the fluidity and PCR contamination is improved insufficiently.

The Metal oxide fine powder contains tin oxide in the amount of 20 to 80 wt %, preferably 25 to 70 wt %. If the amount of tin oxide is less than 20 wt %, the metal oxide can not effectively eliminate the drum contamination, and thereby causing uneven image. If the amount is more than 80 wt %, the decreased triblelectrification causes uneven image. The Examples of the metal oxide containing tin oxide can be titanium dioxide, aluminium oxide, zinc oxide, magnesium oxide, cerium oxide, iron oxide, and copper oxide which contain tin oxide, but are not limited thereto.

The amount of metal oxide fine powder is preferably 0.05 to 0.5 parts by weight, more preferably 0.1 to 0.4 with respect to 100 parts by weight of toner mother particle. If the amount is less than 0.05 parts by weight, the drum contamination causes the uneven image. If the amount is more than 0.5 parts by weight, the abrasion of the drum occurs.

In another embodiment, the present invention relates to a method of applying the positive chargeable magnetic toner composition for a non-contact type image forming apparatus comprising OPC. The image forming apparatus comprising organic photo conductor (OPC) which operates in a non-contacting method can be used in the present invention.

For example, the image forming apparatus comprises OPC, a member of charging the OPC, a member of forming latent image on OPC, a member of receiving toner, a member of developing latent image on OPC and forming toner image, and a member of transfer the toner image into transfer member.

The developing method using mono-component toner can be classified into a contact type image forming method, and a non-contact type image forming method. The non-contact type method, the toner is charged by friction with doctor blade and sleeve, and the toner layer is formed by a magnetic blade. The toner layer is transferred to latent image on the surface of OPC drum by applying direct current bias and alternating current bias. The non-contact type method is advantageous in minimizing the contamination of non-image region.

On the other hand, in the contact type method, the toner is charged by friction with doctor blade, and the toner layer is formed by elastic blade. This method has advantages of forming an excellent solid image, and line reproducibility. However, the contact type method has problems of accelerating an abrasion of OPC drum surface, because the toner layer is always contacting with the surface of OPC drum.

Also, the drum surface is worn away by repeatedly contacting with OPC drum in the non-contact type. However, the toner of the present invention can decrease or suppress such abrasion of the drum surface, and thereby providing high image density and clear image quality.

The present invention is further explained in more detail with reference to the following examples. These examples, however, should not be interpreted as limiting the scope of the present invention in any manner.

EXAMPLE 1

1. Preparation of Toner Mother Particle 40 parts by weight of Styren-butadiene copolymer as a binder resin, 45 parts by weight of iron oxide as a magnetic component, 2 parts by weight of nigrosine as a charge control agent, and 5 parts by weight of polyethylene with low molecular weight (like as Mw 2,000) as a releasing agent were mixed with a Henchel Mixer. The mixture was melted and kneaded at 155° C. in a twin extruder, pulverized with a jet mill crusher, and classified with an air classifier to obtain a toner mother particle having a volume-average particle size of 9.1 μm.

2. Preparation of Positive Chargeable Toner

With respect to the 100 parts by weight of the magnetic toner particle, 0.1 parts by weight of hydrophobic silica treated with hexamethyidisilazane(HMDS) having the specific surface area of 90 $m^2/g$, 0.05 parts by weight of polyvinylidene fluoride(PVDF) having average particle size of 0.1 μm, and 0.3 parts by weight of titanium oxide which contains 45 wt % of tin, and has average particle size of 50 nm are adhered to the magnetic toner particle by mixing with a Henchel Mixer for 5 minutes, to produce a positive chargeable mono-component toner.

EXAMPLE 2~89, AND COMPARATIVE EXAMPLE 1~32

The hydrophobic silica with negative charge treated according to the method as shown in Table 1, the metal oxide containing tin as shown in Table 2, and PVDF are mixed in the composition as shown in Table 3 and are adhered to the magnetic toner particle by mixing with a Henchel Mixer for 5 minutes, to produce a positive chargeable mono-component toner in Examples 2-89, and Comparative Examples 1-32.

TABLE 1

| Category | Specific surface area ($m^2/g$) | Hydrophobic treatment |
|---|---|---|
| Silica A | 90 | HMDS |
| Silica B | 130 | HMDS |
| Silica C | 180 | HMDS |

In the Table 1, the specific surface area of the silica refers to a measurement of the BET method.

TABLE 2

| Metal Oxide | Titanium oxide (wt %) | Tin oxide (wt %) | Average particle size (nm) |
|---|---|---|---|
| Metal Oxide A | 85 | 15 | 50 |
| Metal Oxide B | 55 | 45 | 50 |
| Metal Oxide C | 15 | 85 | 50 |
| Metal Oxide D | 100 | 0 | 130 |
| Metal Oxide E | 85 | 15 | 130 |
| Metal Oxide F | 55 | 45 | 130 |
| Metal Oxide G | 15 | 85 | 130 |
| Metal Oxide H | 85 | 15 | 500 |
| Metal Oxide I | 55 | 45 | 500 |
| Metal Oxide J | 15 | 85 | 500 |

TABLE 3

| EXAMPLE | Silica (parts by weight) | PVDF(average particle size, parts by weight) | Metal oxide(parts by weight) |
|---|---|---|---|
| 2 | Silica A, 0.1 | 0.1 μm. 0.2 | Metal oxide F, 0.3 |
| 3 | Silica A, 0.1 | 0.1 μm. 0.4 | Metal oxide F, 0.3 |
| 4 | Silica A, 0.3 | 0.1 μm. 0.05 | Metal oxide F, 0.3 |
| 5 | Silica A, 0.3 | 0.1 μm. 0.2 | Metal oxide F, 0.3 |
| 6 | Silica A, 0.3 | 0.1 μm. 0.4 | Metal oxide F, 0.3 |
| 7 | Silica A, 0.5 | 0.1 μm. 0.05 | Metal oxide F, 0.3 |
| 8 | Silica A, 0.5 | 0 1 μm. 0.2 | Metal oxide F, 0.3 |
| 9 | Silica A, 0.5 | 0.1 μm. 0.4 | Metal oxide F, 0.3 |
| 10 | Silica B, 0.1 | 0.1 μm. 0.05 | Metal oxide F, 0.3 |
| 11 | Silica B, 0.1 | 0.1 μm. 0.2 | Metal oxide F, 0.3 |
| 12 | Silica B, 0.1 | 0.1 μm. 0.4 | Metal oxide F, 0.3 |
| 13 | Silica B, 0.3 | 0.1 μm. 0.05 | Metal oxide F, 0.3 |
| 14 | Silica B, 0.3 | 0.1 μm. 0.2 | Metal oxide F, 0.3 |
| 15 | Silica B, 0.3 | 0.1 μm. 0.4 | Metal oxide F, 0.3 |
| 16 | Silica B, 0.5 | 0.1 μm. 0.05 | Metal oxide F, 0.3 |
| 17 | Silica B, 0.5 | 0.1 μm. 0.2 | Metal oxide F, 0.3 |
| 18 | Silica B, 0.5 | 0.1 μm. 0.4 | Metal oxide F, 0.3 |
| 19 | Silica C, 0.1 | 0.1 μm. 0.05 | Metal oxide F, 0.3 |
| 20 | Silica C, 0.1 | 0.1 μm. 0.2 | Metal oxide F, 0.3 |
| 21 | Silica C, 0.1 | 0.1 μm. 0.4 | Metal oxide F, 0.3 |
| 22 | Silica C, 0.3 | 0.1 μm. 0.05 | Metal oxide F, 0.3 |
| 23 | Silica C, 0.3 | 0.1 μm. 0.2 | Metal oxide F, 0.3 |
| 24 | Silica C, 0.3 | 0.1 μm. 0.4 | Metal oxide F, 0.3 |
| 25 | Silica C, 0.5 | 0.1 μm. 0.05 | Metal oxide F, 0.3 |
| 26 | Silica C, 0.5 | 0.1 μm. 0.2 | Metal oxide F, 0.3 |

TABLE 3-continued

| EXAMPLE | Silica (parts by weight) | PVDF(average particle size, parts by weight) | Metal oxide(parts by weight) |
|---|---|---|---|
| 27 | Silica C, 0.5 | 0.1 μm. 0.4 | Metal oxide F, 0.3 |
| 28 | Silica A, 0.1 | 0.5 μm. 0.05 | Metal oxide F, 0.3 |
| 29 | Silica A, 0.1 | 0.5 μm. 0.2 | Metal oxide F, 0.3 |
| 30 | Silica A, 0.1 | 0.5 μm. 0.4 | Metal oxide F, 0.3 |
| 31 | Silica A, 0.3 | 0.5 μm. 0.05 | Metal oxide F, 0.3 |
| 32 | Silica A, 0.3 | 0.5 μm. 0.2 | Metal oxide F, 0.3 |
| 33 | Silica A, 0.3 | 0.5 μm. 0.4 | Metal oxide F, 0.3 |
| 34 | Silica A, 0.5 | 0.5 μm. 0.05 | Metal oxide F, 0.3 |

TABLE 4

| EXAMPLE | Silica (parts by weight) | PVDF(average particle size, parts by weight) | Metal oxide (parts by weight) |
|---|---|---|---|
| 35 | Silica A, 0.5 | 0.5 μm. 0.2 | Metal oxide F, 0.3 |
| 36 | Silica A, 0.5 | 0.5 μm. 0.4 | Metal oxide F, 0.3 |
| 37 | Silica B, 0.1 | 0.5 μm. 0.05 | Metal oxide F, 0.3 |
| 38 | Silica B, 0.1 | 0.5 μm. 0.2 | Metal oxide F, 0.3 |
| 39 | Silica B, 0.1 | 0.5 μm. 0.4 | Metal oxide F, 0.3 |
| 40 | Silica B, 0.3 | 0.5 μm. 0.05 | Metal oxide F, 0.3 |
| 41 | Silica B, 0.3 | 0.5 μm. 0.2 | Metal oxide F, 0.3 |
| 42 | Silica B, 0.3 | 0.5 μm. 0.4 | Metal oxide F, 0.3 |
| 43 | Silica B, 0.5 | 0.5 μm. 0.05 | Metal oxide F, 0.3 |
| 44 | Silica B, 0.5 | 0.5 μm. 0.2 | Metal oxide F, 0.3 |
| 45 | Silica B, 0.5 | 0.5 μm. 0.4 | Metal oxide F, 0.3 |
| 46 | Silica C, 0.1 | 0.5 μm. 0.05 | Metal oxide F, 0.3 |
| 47 | Silica C, 0.1 | 0.5 μm. 0.2 | Metal oxide F, 0.3 |
| 48 | Silica C, 0.1 | 0.5 μm. 0.4 | Metal oxide F, 0.3 |
| 49 | Silica C, 0.3 | 0.5 μm. 0.05 | Metal oxide F, 0.3 |
| 50 | Silica C, 0.3 | 0.5 μm. 0.2 | Metal oxide F, 0.3 |
| 51 | Silica C, 0.3 | 0.5 μm. 0.4 | Metal oxide F, 0.3 |
| 52 | Silica C, 0.5 | 0.5 μm, 0.05 | Metal oxide F, 0.3 |
| 53 | Silica C, 0.5 | 0.5 μm, 0.2 | Metal oxide F, 0.3 |
| 54 | Silica C, 0.5 | 0.5 μm, 0.4 | Metal oxide F, 0.3 |
| 55 | Silica A, 0.1 | 4.0 μm, 0.05 | Metal oxide F, 0.3 |
| 56 | Silica A, 0.1 | 4.0 μm, 0.2 | Metal oxide F, 0.3 |
| 57 | Silica A, 0.1 | 4.0 μm, 0.4 | Metal oxide F, 0.3 |
| 58 | Silica A, 0.3 | 4.0 μm, 0.05 | Metal oxide F, 0.3 |
| 59 | Silica A, 0.3 | 4.0 μm, 0.2 | Metal oxide F, 0.3 |
| 60 | Silica A, 0.3 | 4.0 μm, 0.4 | Metal oxide F, 0.3 |
| 61 | Silica A, 0.5 | 4.0 μm, 0.05 | Metal oxide F, 0.3 |
| 62 | Silica A, 0.5 | 4.0 μm, 0.2 | Metal oxide F, 0.3 |
| 63 | Silica A, 0.5 | 4.0 μm, 0.4 | Metal oxide F, 0.3 |
| 64 | Silica B, 0.1 | 4.0 μm, 0.05 | Metal oxide F, 0.3 |
| 65 | Silica B, 0.1 | 4.0 μm, 0.2 | Metal oxide F, 0.3 |
| 66 | Silica B, 0.1 | 4.0 μm, 0.4 | Metal oxide F, 0.3 |
| 67 | Silica B, 0.3 | 4.0 μm, 0.05 | Metal oxide F, 0.3 |
| 68 | Silica B, 0.3 | 4.0 μm, 0.2 | Metal oxide F, 0.3 |

TABLE 5

| EXAMPLE | Silica (parts by weight) | PVDF(average particle size, parts by weight) | Metal oxide(parts by weight) |
|---|---|---|---|
| 69 | Silica B, 0.3 | 4.0 μm, 0.4 | Metal oxide F, 0.3 |
| 70 | Silica B, 0.5 | 4.0 μm, 0.05 | Metal oxide F, 0.3 |
| 71 | Silica B, 0.5 | 4.0 μm, 0.2 | Metal oxide F, 0.3 |
| 72 | Silica B, 0.5 | 4.0 μm, 0.4 | Metal oxide F, 0.3 |
| 73 | Silica C, 0.1 | 4.0 μm, 0.05 | Metal oxide F, 0.3 |
| 74 | Silica C, 0.1 | 4.0 μm, 0.2 | Metal oxide F, 0.3 |
| 75 | Silica C, 0.1 | 4.0 μm, 0.4 | Metal oxide F, 0.3 |
| 76 | Silica C, 0.3 | 4.0 μm, 0.05 | Metal oxide F, 0.3 |
| 77 | Silica C, 0.3 | 4.0 μm, 0.2 | Metal oxide F, 0.3 |
| 78 | Silica C, 0.3 | 4.0 μm, 0.4 | Metal oxide F, 0.3 |
| 79 | Silica C, 0.5 | 4.0 μm, 0.05 | Metal oxide F, 0.3 |
| 80 | Silica C, 0.5 | 4.0 μm, 0.2 | Metal oxide F, 0.3 |
| 81 | Silica C, 0.5 | 4.0 μm, 0.4 | Metal oxide F, 0.3 |
| 82 | Silica B, 0.3 | 0.5 μm, 0.2 | Metal oxide B, 0.05 |
| 83 | Silica B, 0.3 | 0.5 μm, 0.2 | Metal oxide B, 0.3 |
| 84 | Silica B, 0.3 | 0.5 μm, 0.2 | Metal oxide B, 0.5 |
| 85 | Silica B, 0.3 | 0.5 μm, 0.2 | Metal oxide F, 0.05 |

TABLE 5-continued

| EXAMPLE | Silica (parts by weight) | PVDF(average particle size, parts by weight) | Metal oxide(parts by weight) |
|---|---|---|---|
| 86 | Silica B, 0.3 | 0.5 μm, 0.2 | Metal oxide F, 0.5 |
| 87 | Silica B, 0.3 | 0.5 μm, 0.2 | Metal oxide I, 0.05 |
| 88 | Silica B, 0.3 | 0.5 μm, 0.2 | Metal oxide I, 0.3 |
| 89 | Silica B, 0.3 | 0.5 μm, 0.2 | Metal oxide I, 0.5 |

TABLE 6

| COMPARATIVE EXAMPLE | Silica (parts by weight) | PVDF(average particle size, parts by | Metal oxide (parts by weight) |
|---|---|---|---|
| 1 | Silica B, 0.3 | 0.1 μm, 0.04 | Metal oxide F, 0.3 |
| 2 | Silica B, 0.3 | 0.1 μm, 0.5 | Metal oxide F, 0.3 |
| 3 | Silica B, 0.05 | 0.5 μm, 0.2 | Metal oxide F, 0.3 |
| 4 | Silica B, 0.6 | 0.5 μm, 0.2 | Metal oxide F, 0.3 |
| 5 | Silica B, 0.3 | 0.5 μm, 0.2 | Metal oxide B, 0.02 |
| 6 | Silica B, 0.3 | 0.5 μm, 0.2 | Metal oxide B, 0.6 |
| 7 | Silica B, 0.3 | 0.5 μm, 0.2 | Metal oxide F, 0.02 |
| 8 | Silica B, 0.3 | 0.5 μm, 0.2 | Metal oxide F, 0.6 |
| 9 | Silica B, 0.3 | 0.5 μm, 0.2 | Metal oxide I, 0.02 |
| 10 | Silica B, 0.3 | 0.5 μm, 0.2 | Metal oxide I, 0.6 |
| 11 | Silica B, 0.3 | 0.5 μm, 0.2 | Metal oxide A, 0.5 |
| 12 | Silica B, 0.3 | 0.5 μm, 0.2 | Metal oxide C, 0.5 |
| 13 | Silica B, 0.3 | 0.5 μm, 0.2 | Metal oxide D, 0.5 |
| 14 | Silica B, 0.3 | 0.5 μm, 0.2 | Metal oxide E, 0.5 |
| 15 | Silica B, 0.3 | 0.5 μm, 0.2 | Metal oxide G, 0.5 |
| 16 | Silica B, 0.3 | 0.5 μm, 0.2 | Metal oxide H, 0.5 |
| 17 | Silica B, 0.3 | 0.5 μm, 0.2 | Metal oxide J, 0.5 |
| 18 | — | 0.5 μm, 0.05 | Metal oxide F, 0.5 |
| 19 | — | 0.5 μm, 0.2 | Metal oxide F, 0.5 |
| 20 | — | 0.5 μm, 0.4 | Metal oxide F, 0.5 |
| 21 | Silica B, 0.1 | — | Metal oxide F, 0.5 |
| 22 | Silica B, 0.3 | — | Metal oxide F, 0.5 |
| 23 | Silica B, 0.5 | — | Metal oxide F, 0.5 |
| 24 | Silica B, 0.1 | 0.5 μm, 0.05 | — |
| 25 | Silica B, 0.1 | 0.5 μm, 0.2 | — |
| 26 | Silica B, 0.1 | 0.5 μm, 0.4 | — |
| 27 | Silica B, 0.3 | 0.5 μm, 0.05 | — |
| 28 | Silica B, 0.3 | 0.5 μm, 0.2 | — |
| 29 | Silica B, 0.3 | 0.5 μm, 0.4 | — |
| 30 | Silica B, 0.5 | 0.5 μm, 0.05 | — |
| 31 | Silica B, 0.5 | 0.5 μm, 0.2 | — |
| 32 | Silica B, 0.5 | 0.5 μm, 0.4 | — |

COMPARATIVE EXAMPLE 33

With respect to 100 parts by weight of the magnetic toner particle, 0.1 parts by weight of hydrophobic silica treated with amine coupling agent having the specific surface area of 100 $m^2/g$, 0.05 parts by weight of PVDF having average particle size of 0.1 μm, and 0.3 parts by weight of titanium oxide which contains 45 wt % of tin, and has average particle size of 50 nm are adhered to the magnetic toner particle by mixing with a Henchel Mixer for 5 minutes, to produce a positive chargeable mono-component toner.

TEXT EXAMPLE 1

The positive chargeable mono-component toner prepared in Examples 1 to 89, and Comparative examples 1-33 were applied to the non-contact type of copier (NP 3020, Lotte Canon Co. LTD) at the temperature of 20° C. and relative humidity of 55 ±5% to copy 50,000 sheets of paper. The image density, -background contamination (fogging image) and drum contamination were measured according to the following method, and then the result were shown in Tables.

1) Image Density (Blackness)

The image density of solid area image were measure by Macbeth reflection desitometer RD918. In case of the image density is 1.30 or more, the toner can be used in the present invention 2) Background Contamination (Fogging Image)

Non-image region were observed under microscope with naked eye.

○: the background contamination of image was not observed

Δ: The background contamination of image was partly observed

×: The background contamination of image was definitely observed

3) Developing Drum Contamination/Abrasion

After the toner was transferred to paper, the drum separated from copier was observed under microscope with naked eye ○: drum contamination was not observed Δ: drum contamination was partly observed. That is, drum contamination was not shown in image, and thus the toner could be used.

×: drum contamination was definitely observed, and thus the image density was deteriorated.

TABLE 7

| Category | Image density | Background contamination | Drum contamination |
|---|---|---|---|
| 1 | 1.33 | ○ | Δ |
| 2 | 1.34 | ○ | Δ |
| 3 | 1.36 | Δ | Δ |
| 4 | 1.35 | ○ | ○ |
| 5 | 1.37 | ○ | ○ |
| 6 | 1.35 | Δ | ○ |
| 7 | 1.32 | ○ | ○ |
| 8 | 1.36 | ○ | ○ |
| 9 | 1.37 | Δ | ○ |
| 10 | 1.31 | ○ | Δ |
| 11 | 1.31 | ○ | Δ |
| 12 | 1.32 | Δ | Δ |
| 13 | 1.33 | ○ | ○ |
| 14 | 1.35 | ○ | ○ |
| 15 | 1.36 | Δ | ○ |
| 16 | 1.37 | ○ | ○ |
| 17 | 1.37 | ○ | ○ |
| 18 | 1.36 | Δ | ○ |
| 19 | 1.32 | ○ | Δ |
| 20 | 1.31 | ○ | Δ |
| 21 | 1.32 | Δ | ○ |
| 22 | 1.31 | ○ | Δ |
| 23 | 1.33 | ○ | Δ |
| 24 | 1.34 | Δ | ○ |
| 25 | 1.32 | ○ | ○ |
| 26 | 1.34 | ○ | ○ |
| 27 | 1.37 | Δ | ○ |
| 28 | 1.31 | ○ | ○ |
| 29 | 1.31 | ○ | ○ |
| 30 | 1.32 | Δ | ○ |
| 31 | 1.33 | ○ | Δ |
| 32 | 1.34 | ○ | Δ |
| 33 | 1.31 | ○ | ○ |
| 34 | 1.32 | Δ | ○ |
| 35 | 1.31 | ○ | Δ |

TABLE 8

| Category | Image density | Background contamination | Drum contamination |
|---|---|---|---|
| 36 | 1.32 | ○ | ○ |
| 37 | 1.32 | Δ | ○ |
| 38 | 1.31 | ○ | Δ |
| 39 | 1.31 | ○ | ○ |
| 40 | 1.33 | Δ | ○ |

TABLE 8-continued

| Category | Image density | Background contamination | Drum contamination |
|---|---|---|---|
| 41 | 1.32 | ○ | Δ |
| 42 | 1.31 | ○ | ○ |
| 43 | 1.32 | Δ | ○ |
| 44 | 1.33 | ○ | Δ |
| 45 | 1.34 | ○ | Δ |
| 46 | 1.32 | Δ | Δ |
| 47 | 1.31 | ○ | ○ |
| 48 | 1.36 | ○ | ○ |
| 49 | 1.36 | Δ | ○ |
| 50 | 1.31 | ○ | ○ |
| 51 | 1.32 | ○ | ○ |
| 52 | 1.31 | Δ | ○ |
| 53 | 1.33 | ○ | ○ |
| 54 | 1.32 | ○ | Δ |
| 55 | 1.34 | Δ | ○ |
| 56 | 1.33 | ○ | ○ |
| 57 | 1.32 | ○ | ○ |
| 58 | 1.36 | Δ | ○ |
| 59 | 1.33 | ○ | ○ |
| 60 | 1.32 | ○ | ○ |
| 61 | 1.34 | ○ | ○ |
| 62 | 1.31 | ○ | ○ |
| 63 | 1.32 | ○ | ○ |
| 64 | 1.33 | Δ | ○ |
| 65 | 1.35 | ○ | Δ |
| 66 | 1.37 | ○ | Δ |
| 67 | 1.36 | Δ | Δ |
| 68 | 1.35 | ○ | ○ |
| 69 | 1.33 | ○ | ○ |
| 70 | 1.32 | Δ | ○ |

TABLE 9

| Category | Image density | Background contamination | Drum contamination |
|---|---|---|---|
| 71 | 1.35 | ○ | ○ |
| 72 | 1.33 | ○ | ○ |
| 73 | 1.32 | Δ | ○ |
| 74 | 1.36 | ○ | Δ |
| 75 | 1.35 | ○ | Δ |
| 76 | 1.32 | Δ | ○ |
| 77 | 1.33 | ○ | ○ |
| 78 | 1.36 | ○ | ○ |
| 79 | 1.31 | Δ | ○ |
| 80 | 1.34 | ○ | ○ |
| 81 | 1.37 | ○ | ○ |
| 82 | 1.34 | Δ | ○ |
| 83 | 1.35 | ○ | Δ |
| 84 | 1.36 | ○ | Δ |
| 85 | 1.31 | ○ | ○ |
| 86 | 1.36 | Δ | ○ |
| 87 | 1.31 | Δ | ○ |
| 88 | 1.33 | ○ | ○ |
| 89 | 1.35 | ○ | ○ |

TABLE 10

| Category | Image density | Background contamination | Drum contamination |
|---|---|---|---|
| 1 | 1.15 | Δ | X |
| 2 | 1.28 | X | Δ |
| 3 | 1.22 | Δ | X |
| 4 | 1.19 | X | X |
| 5 | 1.23 | Δ | X |
| 6 | 1.25 | X | Δ |
| 7 | 1.28 | Δ | X |
| 8 | 1.31 | X | Δ |
| 9 | 1.32 | Δ | X |
| 10 | 1.13 | X | Δ |

TABLE 10-continued

| Category | Image density | Background contamination | Drum contamination |
|---|---|---|---|
| 11 | 1.14 | Δ | X |
| 12 | 1.17 | X | Δ |
| 13 | 1.15 | Δ | X |
| 14 | 1.19 | Δ | X |
| 15 | 1.21 | X | Δ |
| 16 | 1.23 | Δ | X |
| 17 | 1.18 | X | Δ |
| 18 | 1.20 | Δ | X |
| 19 | 1.18 | Δ | Δ |
| 20 | 1.19 | Δ | Δ |
| 21 | 1.11 | X | X |
| 22 | 1.12 | X | X |
| 23 | 1.15 | Δ | X |
| 24 | 1.14 | Δ | X |
| 25 | 1.16 | Δ | X |
| 26 | 1.18 | Δ | X |
| 27 | 1.22 | X | X |
| 28 | 1.25 | Δ | X |
| 29 | 1.30 | Δ | X |
| 30 | 1.13 | X | X |
| 31 | 1.15 | Δ | X |
| 32 | 1.17 | Δ | X |
| 33 | 1.42(2.0K), 1.05 (10.0K) | ○ | ○ |

As shown in the Tables, the positive chargeable mono-component toner

A shown in the Tables, the positive chargeable mono-component toner in Examples 1 to 89 had sufficient image density of 1.30 equal to or more, and low background contamination of image and drum surface contamination. On the other hand, the toner in Comparative examples 1-32 had serious problems in practical application due to drum surface contamination, background contamination of image. Comparative example 33 using hydrophobic silica with positive charge shown high blackness at an early stage, but did not maintain the blackness during copy of 10,000 sheets. That is, the charged toner was used at a time, and thus, the toner did not transferred to OPC surface due to the exhaustion of the charged toner, as the number of copied paper increased the in Comparative Example 33.

As described in the above, positive chargeable magnetic toner composition according to the present invention has advantages in the extended life of the drum, reduction of the background contamination, and improvement of long-term reliability.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A mono-component toner composition with positive charge comprising:

i) 100 parts by weight of a magnetic toner particle comprising a binder resin, a magnetic component, and a charge control agent with positive charge;

ii) 0.1 to 0.5 parts by weight of a hydrophobic silica with negative charge having 100 to 150 $m^2/g$ of specific surface area;

iii) 0.05 to 0.4 parts by weight of a fluorinated organic fine powder, the fluorinated organic powder having average particle size of 0.5 to 4.0 μm; and iv) 0.1 to 0.4 parts by weight of a metal oxide fine powder consisting of 20 to 80 wt % of tin oxide and the remaining percentage of at least one metal oxide selected from the group consisting of titanium dioxide, aluminum oxide, zinc oxide, magnesium oxide, cerium oxide, iron oxide, and copper oxide.

2. The mono-component toner composition of claim 1, wherein the magnetic toner particle comprises a 20 to 80 parts by weight of binder resin, 20 to 70 parts by weight of the magnetic component, and 0.15 to 4.0 parts by weight of the charge control agent with positive charge with respect to total weight of the magnetic toner particle.

3. The mono-component toner composition of claim 1, wherein the binder resins is at least one selected from the group consisting of poly(methyl acrylate), poly(ethyl acrylate), poly(butyl acrylate), poly(2-ethylhexyl acrylate), poly (lauryl acrylate), poly(methyl methacrylate), poly(butyl methacrylate), poly(hexyl methacrylate), poly(2-ethylhexyl methacrylate), poly(lauryl methacrylate), a copolymer of acrylic acid ester and methacrylic acid ester, a copolymer of a styrene monomer and acrylic acid ester, a copolymer of styrene monomer and methacrylic acid, poly(vinyl acetate), poly(vinyl propionate), poly(vinyl lactate), polyethylene, polypropylene, a styrene-butadiene copolymer, a styrene-isoprene copolymer, a styrene-maleic acid copolymer, poly(vinyl ether), poly(vinyl ketone), polyamide, polyurethane, a rubber, an epoxy resin, a poly(vinyl butyral) resin, a modified resin, a phenol resin, and a mixture thereof.

4. The mono-component toner composition of claim 1. wherein the magnetic component is at least one selected from the group consisting of magnetite, hematite, ferrite, iron, cobalt, nickel, manganese, a metal alloy containing aluminium, copper, lead, magnesium, selenium, titanium, tungsten, vanadium, a ferromagnetic alloy, a magnetic oxide and a mixture thereof.

5. The mono-component toner composition of claim 1, wherein the charge control agent with positive charge is nigrosine or quaternary ammonium salts.

6. The mono-component toner composition of claim 1, wherein the magnetic toner particle comprises 0.05 to 5 parts by weight of a releasing agent with respect to 100 parts by weight of the magnetic toner particle.

7. The mono-component toner composition of claim 1. wherein the magnetic toner particle has average particle size of 5 to 30 μm.

8. The mono-component toner composition of claim 1, wherein the hydrophobic silica is prepared by coating or adhering the silica particle with a silane coupling agent or silicone oil.

9. The mono-component toner composition of claim 1, wherein the flurorinated organic fine powder is at least one selected from the group consisting of polyfluorovinylidene, polytetrafluoroethlyene; fluorinated stryren-acrylic acid copolymer; fluorinated polyethylene; fluorinated polyacrylate; and copolymer thereof.

* * * * *